United States Patent [19]

Marquardt

[11] Patent Number: 4,917,388

[45] Date of Patent: Apr. 17, 1990

[54] RESETTING GUN TARGET

[76] Inventor: Wayne Marquardt, 1902 W. 6th St., Mishawaka, Ind. 46544

[21] Appl. No.: 332,586

[22] Filed: Apr. 3, 1989

[51] Int. Cl.[4] ..... F41J 7/00

[52] U.S. Cl. ..... 273/392; 273/407

[58] Field of Search ..... 273/390, 391, 392, 407

[56] References Cited

U.S. PATENT DOCUMENTS

| | | | |
|---|---|---|---|
| 2,538,118 | 1/1951 | Miller | 273/407 |
| 4,614,345 | 9/1986 | Doughty | 273/392 X |
| 4,773,652 | 9/1988 | Mosser | 273/392 |
| 4,842,283 | 6/1989 | LeBel et al. | 273/392 |

*Primary Examiner*—Anton O. Oechsle
*Attorney, Agent, or Firm*—Todd A. Dawson

[57] ABSTRACT

A gun target supported by a frame at an oblique angle which upon impact pivots about a hinge pin. The target resets itself to the ready position by nature of an over-center relationship between the hinge pin and target. The target is angled with respect to the shooter to deflect the projectile either downwardly or upwardly dependent upon target orientation. Since the target is angled with respect to the shooter the target is elongated so as to present a visually correct image to the shooter.

10 Claims, 4 Drawing Sheets

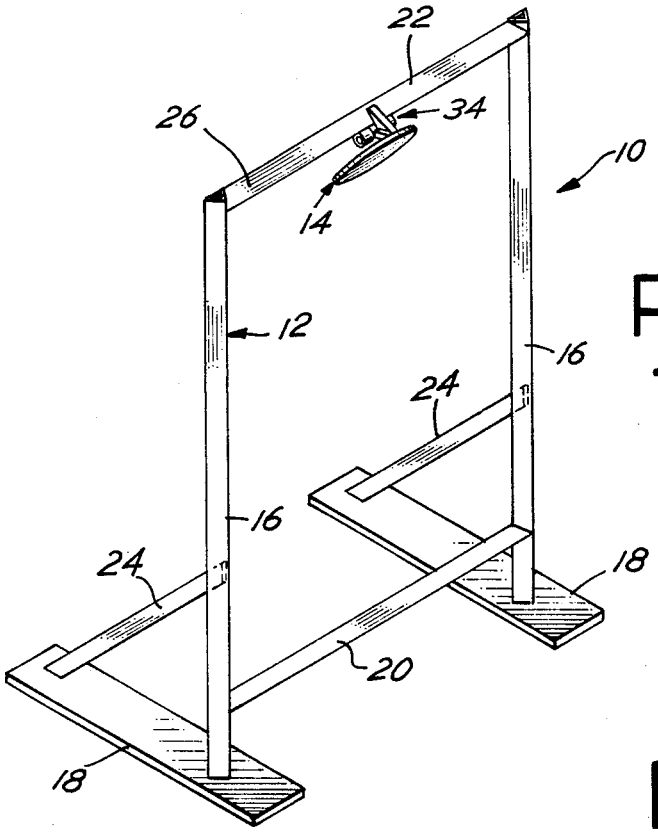
Fig.1
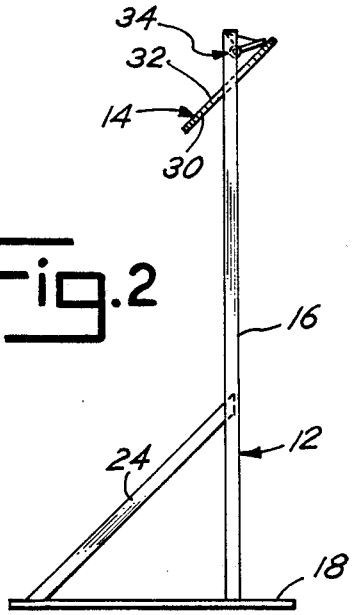
Fig.2
Fig.3
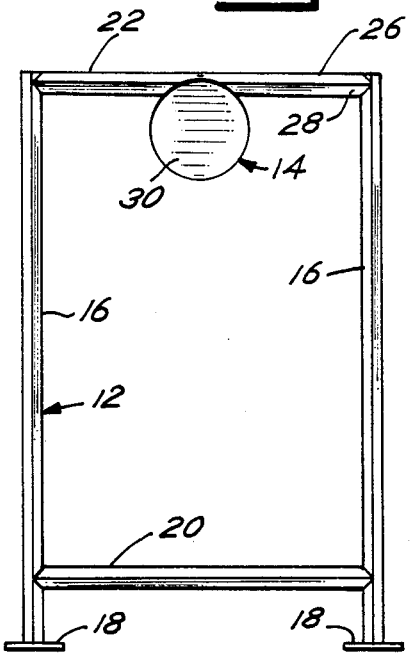

RESETTING GUN TARGET

SUMMARY OF THE INVENTION

This invention relates to a gun target and will have specific reference to a gun target which automatically resets itself after being struck by a projectile.

Heretofore, gun targets were typically designed hinged to a supporting structure so as to fall when struck by a bullet. The target would then be lifted either mechanically or manually into its ready position. The problem with this type of target is that every time the target is struck it must be manually reset. To prevent the continuous resetting of a single target a multitude of such targets were set up for use by a single shooter. Therefore, previous targets were costly in that a shooting range would be required to have many targets available for target practice. Further, someone would need to reset the multitude of targets which requires additional time from the shooter.

The gun target of this invention eliminates the above problems by providing a self-resetting target. When struck, the target pivots about the hinge and abuts a stop to limit its pivotal movement, then automatically pivots back into place under the force of gravity so as to be ready for the next shot. The target in its ready position is suspended at an angle relative to the shooter and after impact directs the bullet or pellets to a safe area. The targets are elongated from top to bottom and have elliptical radiuses to present an appropriately dimensioned target to the shooter when viewed for shooting.

Accordingly, it is an object of this invention to provide for a novel gun target.

Another object of this invention to provide for a gun target which automatically rests itself.

Another object of this invention is to provide for a gun target which diverts the bullet or pellets to a safe area after impact with the target.

Other objects of this invention will have become apparent upon a reading of the following description taken with the accompanying drawings.

BRIEF DESCRIPTION OF THE DRAWINGS

FIG. 1 is a perspective view of a first embodiment of the gun target of this invention.

FIG. 2 is a side elevational view of the target of FIG. 1.

FIG. 3 is a front elevational view of the target of FIG. 1.

DETAILED DESCRIPTION OF THE PREFERRED EMBODIMENTS

Figure 4:
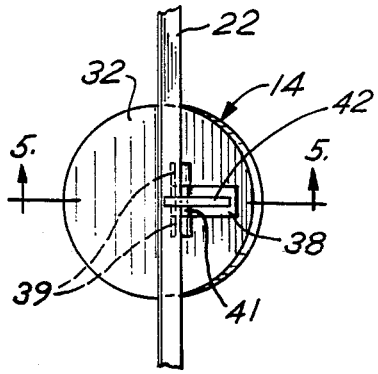
FIG. 4 is a fragmented top plan view of the target of FIG. 1.
Figure 6:
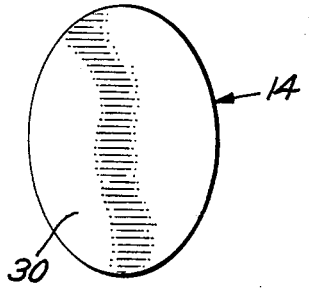
FIG. 6 is an elevational view as seen from line 6—6 of FIG. 5.

The preferred embodiments herein described are not intended to be exhaustive or to limit the invention to the precise forms disclosed. Rather they are chosen and described so that others skilled in the art might utilize their teachings.

Referring now to FIG. 1, gun target assembly 10 includes a support frame 12 and a target 14. Frame 12 includes a pair of vertical legs 16 attached to base plates 18 and interconnected by cross pieces 20 and 22 in a common manner such as welding. A brace 24 extends between each leg 16 and its base plate 18 to provide additional vertical support for the legs. Cross piece 22 includes an upper angled surface 26 and a lower angled surface 28.

It should be understood that in the preferred embodiment frame 12 is formed from angle iron to provide a strengthened frame for target 14. Further, target assembly 10 of FIGS. 1-7 is designed for use with a shotgun. Therefore, frame 12 is designed to define a substantially unobstructed area around target 14. It should therefore be understood that in use the angle iron of frame 12 should be reinforced to be able to sustain a direct hit from a slug fired from a shotgun.

Target 14 includes a front surface 30 and a rear or back surface 32 and is preferably formed from steel having a hardness of at least 28 "C" Rockwell. Target 14 is pivotally connected to cross piece 22 by a hinge 34 which has a hinge plate 38 connected to the rear side 32 of target 14. Two spaced hinge knuckles 39 are connected to cross piece lower surface 28. Hinge half 38 includes a knuckle 41 which is positioned between spaced knuckles 39 and connected thereto as is common by a hinge pin 40. Target 14 further includes a triangular stop 42 which is attached to hinge half 38 so that side 44 of the stop abuts upper surface 26 of cross piece 22 when target 14 is in the at rest or ready position illustrated in FIG. 5.

Figure 5:
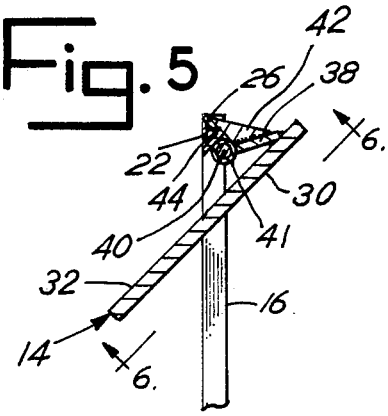
FIG. 5 is a fragmented cross-sectional view taken along line 5—5 of FIG. 4.
Figure 7:
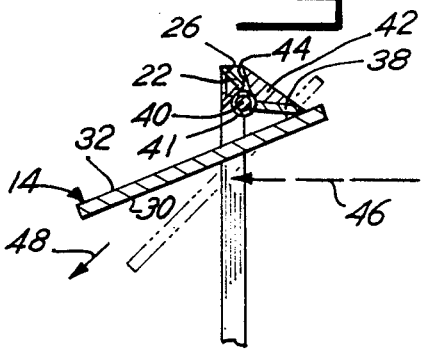
FIG. 7 is a fragmented cross-sectional view similar to FIG. 5 illustrating the position of the target after being impacted by a projectile.

In use, target 14 is connected to hinge 34 so that the weight of the target causes side 44 of stop 42 to contact upper surface 26 of cross piece 22 as illustrated in FIG. 5. This position is referred to as the at rest or ready position. In the ready position of FIG. 5, target 14 is angled at an approximate 45° angle with respect to horizontal to deflect a projectile striking the target downwardly. Therefore to present a round target to the shooter as is desired, target 14 is formed as an ellipse with its longitudinal axis defining the top and bottom of the target. When the shooter (not shown) fires a projectile at the target 14 in the direction of arrow 46 in FIG. 7 and target 14 is struck, the force of the projectile pivots target 14 about hinge 34 into the impacted position illustrated in FIG. 7 thus indicating to the shooter the target was hit. When hinge 34 reaches its fully open position the rearward pivoting of target 14 is stopped and the projectile is diverted in the direction illustrated by arrow 48 in FIG. 7. After the momentary force of impact upon target 14 has dissipated the target pivots forward about hinge 34 until it is in its ready position of FIG. 5 with side 44 of stop 42 contacting upper surface 26 of top 22 as previously described. The motive force which pivots target 14 forward after impact is provided by the over center connection of hinge 34 to target 14 and the rebounding effect of hinge 34 abruptly opening.

Figure 8:
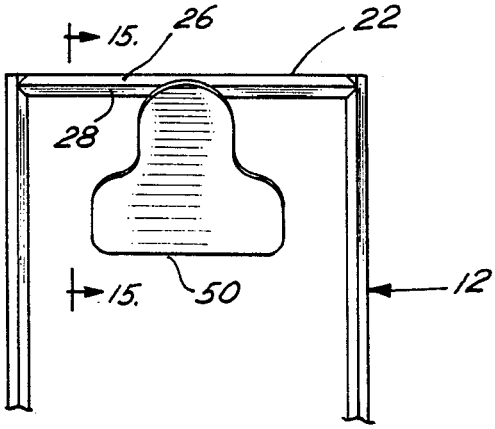
FIG. 8 is a front elevational view of a modified embodiment of the gun target of FIG. 1.
Figure 9:
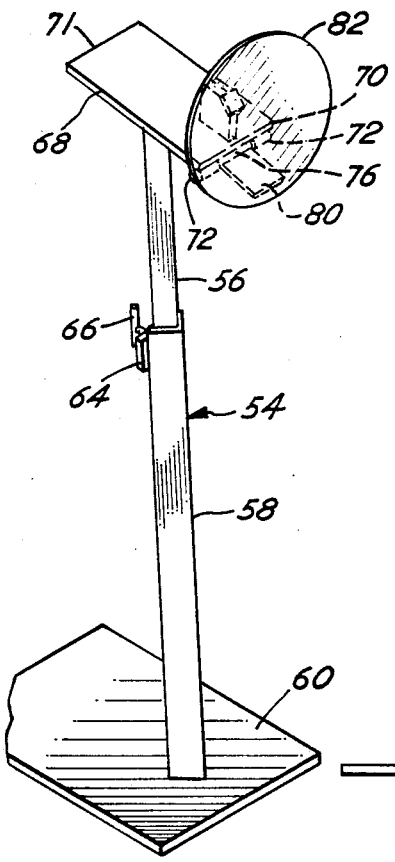
FIG. 9 is a perspective view of a second embodiment of the gun target of this invention.
Figure 15:
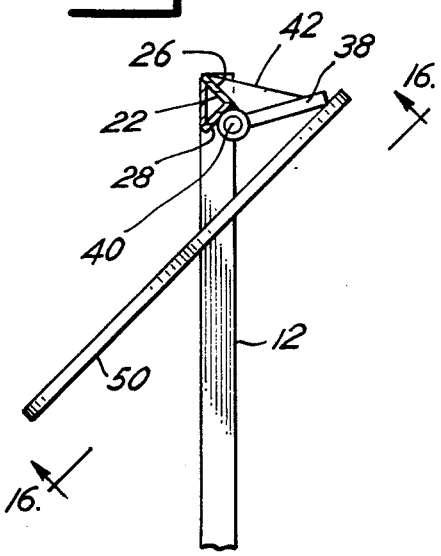
FIG. 15 is a side elevation view of the alternative embodiment of the gun target of FIG. 8.
Figure 16:
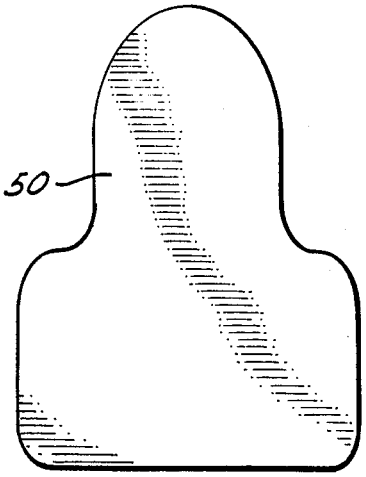
FIG. 16 is a front elevation view of the modified target silhouette.

FIGS. 8, 15 and 16 illustrate the target assembly of FIGS. 1–7 with a silhouette target 50 attached to frame 12 in place of elliptical target 14. Silhouette target 50 as illustrated in FIG. 15 is pivotally attached to frame 12 in the same manner described with reference to elliptical target 14 of FIGS. 1–7. Silhouette target 50 is positioned at an approximate 30° angle with respect to the horizontal to divert the path of a projectile downwardly after impact with the target. Therefore to present an appropriately sized silhouette to the shooter, target 50 is elongated as shown in FIG. 16 and has elliptical radiuses which when suspended as in FIG. 15 gives the shooter the normal dimensioned silhouette target as shown in FIG. 8.

A second embodiment of the gun target assembly of this invention is illustrated in FIGS. 9–13. As illustrated, target assembly 52 includes an adjustable leg assembly 54 having an upper leg extension 56 telescopically received within lower leg 58. Lower leg 58 is attached at one end to a base plate 60 in a common manner. A plate 64 which accommodates a bolt 66 is attached to leg 58 so that bolt 66 may be tightened against leg extension 56 to secure the leg extension against sliding relative to leg 58.

A platform 68 is connected to the upper end of leg extension 56 so as to be slightly downwardly angled from a back edge 71 to a front edge 70. A pair of hinge knuckles 72 are connected to the underside of platform 68 adjacent front edge 70 in a common manner such as welding. A knuckle 76 having fixed flanges 74 and 80 is positioned between knuckles 72 and pivotally attached thereto by hinge pin 78. Flange 74 extends under platform 68 and flange 80 extends beyond front edge 70 of the platform. A target 82 is connected to the end of flange 80 so as to form an acute angle with flange 80 as illustrated. A stop 83 is attached to the upper surface of platform 68 adjacent front edge 70 and includes a vertical extension block 84 and an angled contact pad 86. Contact pad 86 is attached to the upper forwardmost corner of block 84 at an oblique angle as illustrated in the figures.

The target assembly of FIGS. 9–13 is primarily used for handgun target practice, therefore the height of target 82 may be varied from ground level to accommodate differemt shooting positions by loosening bolt 66 and adjusting leg extension 56. When appropriately adjusted, bolt 66 is tightened to secure leg extension 56.

Figure 10:
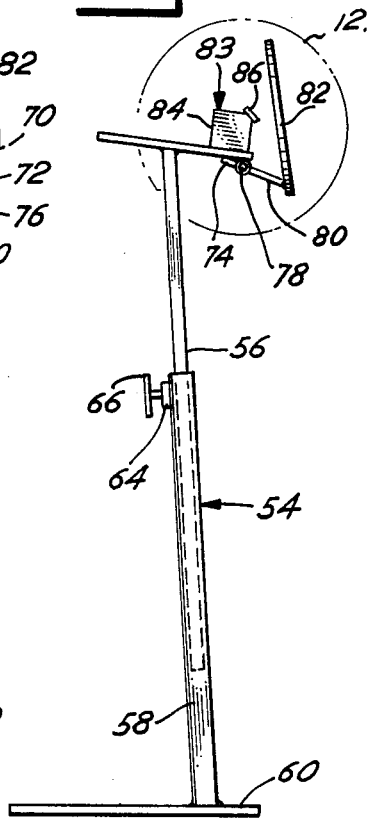
FIG. 10 is a side elevational view of the target of FIG. 9.
Figure 11:
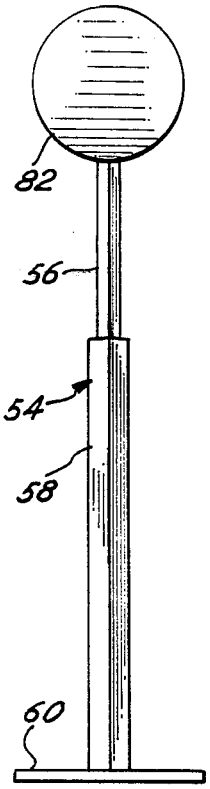
FIG. 11 is a front elevational view of the target of FIG. 9.
Figure 12:
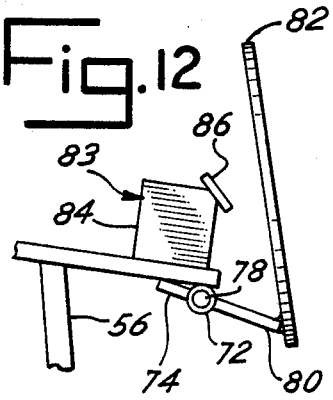
FIG. 12 is a detailed view of the area circled in FIG. 10 designated by number 12.
Figure 13:
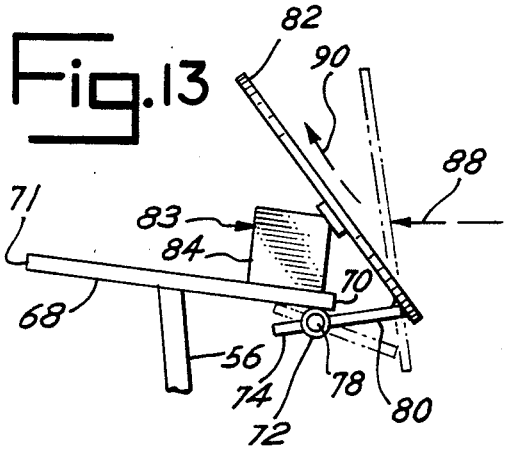
FIG. 13 is a view of the target of FIG. 12 after impacted by a projectile.

With target 82 in rest or ready position of FIGS. 9–12, flange 74 contacts the underside of platform 68 to retain target 82 in an angled orientation relative to the shooter as is illustrated best in FIGS. 10 and 12. When a projectile traveling in the direction of arrow 88 contacts target 82, the impact of the projectile causes the target to pivot upwardly about pin 78. The upward pivotal movement of target 82 is halted when the target contacts contact pad 86 as illustrated in FIG. 13. To distribute the force evenly across contact pad 86, the pad is angled such that its outer surface is adjacent gthe rear surface of the target. Block 84 is used to maintain the contact pad in the correct orientation over continued use of the target assembly. With the target in the impacted position of FIG. 13 the projectile is diverted in the direction of arrow 90.

After the impact force from the projectile dissipates, target 82 pivots about pin 78 into the at rest position of FIG. 12 due to the over-center association of target 82 to hinge pin 78 and the rebounding effect of rapid contact between contact pad 86 and target 82.

Figure 14:
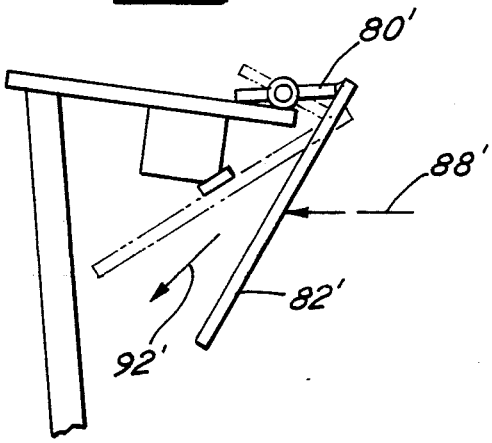
FIG. 14 is a side elevation view of an alternative embodiment of the gun target of FIG. 9.

An alternative orientation of the second embodiment is illustrated in FIG. 14. As shown, the platform and parts connected thereto are turned over such that target 82' is suspended from flange 74'. To allow the target of FIG. 14 to return to its rest position (illustrated by solid lines) the angle formed between target 82' and flange 80' is decreased to increase the over-center relationship of the target and hinge pin. Further as is evident a projectile impacting target 82' from the direction of arrow 88' will be diverted downwardly as illustrated by arrow 92.

It should be understood that all areas which may be subjected to impact by a projectile should be of a sufficient Rockwell hardness so as to prevent structural damage.

It should be further understood that the invention is not to be limited to the precise forms disclosed but may be amended within the scope of the appended claims.

I claim:

1. A target for practicing marksmanship, said target including a frame, a plate defining an impaction surface to be contacted by a projectile, said plate connected to said frame by a pivotal connector, said plate pivotal about said pivotal connector between a ready position and an impacted position, said plate shifted from said ready position to said impacted position when struck by a projectile, said pivotal connector including means for shifting said plate drom its impacted position to its ready position, said pivotal connector includes a hinge, said shifting means includes an over-center orientation between said frame and said plate wherein said plate shifts by its own weight from its impacted position to its ready position under force of gravity.

2. The target of claim 1 wherein said plate impaction surface is elongated in its vertical overall dimensions, said pivotal connector positions said plate at an oblique angle with respect vertical when said plate is in its ready position and constitutes means for optically rectifying the elongation of said target to produce a desired shortened silhouette to the shooter.

3. The target of claim 2 wherein said elongated plate impaction surface has elliptical radiuses.

4. The target of claim 1 wherein said hinge constitutes means for limiting pivotal movement of said plate to thereby define said impacted position.

5. The target of claim 1 including a stop carried by said hinge for contacting said frame to thereby define said ready position of said plate.

6. The target of claim 1 and including a stop carried by said frame for contacting said plate after impaction with a projectile to thereby define said impacted position.

7. The target of claim 1 and including a platform carried by said frame and having upper and lower surfaces, and a front edge, a stop connected to one of said surfaces adjacent said front edge, said pivotal connector attached to the other of said surfaces adjacent said front edge.

8. The target of claim 10 wherein said stop is conencted to either said upper or lower surface of said platform.

9. A target for practicing marksmanship, said target including a frame, a plate defining an impaction surface to be contacted by a projectile, said plate connected to said frame by a pivotal connector, said plate pivotal about said pivotal connector between a ready position and an impacted position, said plate shifted from said ready position to said impacted position when struck by a projectile, said pivotal connector including means for shifting said plate from its impacted position to its ready position, said plate impaction surface being elongated in its vertical overall dimensions, wherein said pivotal connector positions said plate at an oblique angle with respect to the vertical when said plate is in its ready position and constitutes means for optically rectifying the elongation of said target.

10. A target for practicing marksmanship, said target including a frame, a plate defining an impaction surface to be contacted by a projectile, said plate connected to said frame by a pivotal connector, said plate pivotable about said pivotal connector between a ready position and an impacted position, said plate shifted from said ready position to said impacted position when struck by a projectile, said pivotal connector including means for shifting said plate from its impacted position to its ready position, a platform carried by said frame having upper and lower surfaces and a front edge, a stop connected to one of said surfaces adjacent said front edge, said pivotal connector attached to the outer of said surfaces adjacent said front edge.

* * * * *